US009663866B2

(12) United States Patent
Meneghini et al.

(10) Patent No.: US 9,663,866 B2
(45) Date of Patent: May 30, 2017

(54) DIAPHRAGM OF PREDEFINED POROSITY AND METHOD OF MANUFACTURING

(75) Inventors: Giovanni Meneghini, Milan (IT); Corrado Mojana, Valmadrera (IT); Felix Prado, Monzon (ES)

(73) Assignee: INDUSTRIE DE NORA S.P.A., Milan (IT)

( * ) Notice: Subject to any disclaimer, the term of this patent is extended or adjusted under 35 U.S.C. 154(b) by 636 days.

(21) Appl. No.: 13/486,089

(22) Filed: Jun. 1, 2012

(65) Prior Publication Data

US 2012/0234676 A1 Sep. 20, 2012

Related U.S. Application Data

(63) Continuation of application No. PCT/EP2010/068544, filed on Nov. 30, 2010.

(30) Foreign Application Priority Data

Dec. 3, 2009 (IT) ..... MI2009A2139

(51) Int. Cl.
*C25B 13/00* (2006.01)
*C25B 13/08* (2006.01)

(52) U.S. Cl.
CPC ..... *C25B 13/00* (2013.01); *C25B 13/08* (2013.01)

(58) Field of Classification Search
CPC ..... C05B 13/00; C05B 13/04; C05B 13/06; C05B 13/08
USPC ..... 427/243, 247, 376.1, 376.2, 245
See application file for complete search history.

(56) References Cited

U.S. PATENT DOCUMENTS 3,853,721 A * 12/1974 Darlington et al. ..... 205/519
4,186,065 A * 1/1980 Dilmore ..... C25B 13/04 204/295
5,683,749 A * 11/1997 DuBois ..... C25B 13/04 427/243
6,354,443 B1 * 3/2002 Moya ..... B01D 67/0088 210/490
2008/0257722 A1 * 10/2008 Tomba et al. ..... 204/295

FOREIGN PATENT DOCUMENTS

WO 2007030509 A1 3/2007

OTHER PUBLICATIONS

Anonymous: "PMX Diaphragm Brochure" Dec. 1, 2009, URL: http://www.denora.com/Products/tabid/66/ProductItemID/7/Defaultaspx>, p. 1-3.
Search Report dated Jun. 9, 2010 in connection with patent application IT MI20092139, p. 1-6.

* cited by examiner

*Primary Examiner* — Dah-Wei D Yuan
*Assistant Examiner* — Jose Hernandez-Diaz
(74) *Attorney, Agent, or Firm* — Lucas & Mercanti, LLP

(57) ABSTRACT

The invention relates to a cathode for electrolytic processes provided with a catalytic coating based on ruthenium crystallites with highly controlled size falling in a range of 1-10 nm. The coating can be produced by physical vapor deposition of a ruthenium or ruthenium oxide layer.

3 Claims, 5 Drawing Sheets

DIAPHRAGM OF PREDEFINED POROSITY AND METHOD OF MANUFACTURING

CROSS-REFERENCE TO RELATED APPLICATION

This application is a continuation of PCT/EP2010/0068544 filed Nov. 30, 2010, that claims the benefit of the priority date of Italian Patent Application No. MI2009A002139 filed Dec. 3, 2009, the contents of which are herein incorporated by reference in their entirety.

FIELD OF THE INVENTION

The invention relates to a porous separator, in particular a separator suitable for use in diaphragm-type chlor-alkali electrolysis cells.

BACKGROUND OF THE INVENTION

Several electrolytic processes are carried out in cells subdivided into two compartments, an anodic and a cathodic one, by means of a separator comprising a porous diaphragm suitable for separating the products of the anodic and the cathodic reaction, whose mixing could bring about the formation of hazardous mixtures as well as a process efficiency loss. The separator must be chemically resistant to the fluids contained in the cell and provided with suitable electrical conductivity in order to ensure the continuity needed for current transport. The diaphragm pores can become filled, during operation, with process electrolyte solution contained inside the cell. The portion of solution contained inside the pores ensures the required diaphragm electrical conductivity.

Contrary to what happens with other kinds of separators, for example with ion-exchange membranes, porous diaphragms allow the macroscopic passage of solutions and, therefore, do not totally prevent the mixing of anodic and cathodic products. The degree of mixing depends on the diaphragm thickness and porosity and on process conditions, in particular on pressure difference between the two compartments and current density. The field of highest industrial relevance for electrolysis cells provided with a separator in the form of porous diaphragms is given by cells for alkali brine electrolysis for production of chlorine and alkali, to which reference will be specifically made, with no limiting intention, in the description herein.

Diaphragms installed in cells destined for this kind of process in the past typically consisted of a layer comprising asbestos fibres, optionally stabilised by addition of polymer binders. Later on, the growing restrictions to the use of asbestos led to the development of diaphragms consisting of fluorinated polymer fibres, obtained by depositing layers of fibres drawn from an aqueous suspension onto the cathode surface, which for instance consists of a mesh or punched sheet of electrically conducting material. Since the employed polymers have a specific density largely exceeding that of asbestos, the suspension is added with a thickener remarkably increasing the viscosity thereof, thereby counteracting the settling processes, without being able to inhibit them completely. For this reason, the suspension is stored under stirring. While this is crucial in maintaining an acceptable homogeneity in time, it can, nevertheless, cause a decay of the fibres, by fragmenting them into shorter chunks.

Polymer fibres can be coated with hydrophilic particles, for instance based on inert ceramic oxides of metals such as zirconium, with the purpose of making the diaphragm prone to flooding in operating conditions. The suspension may also contain a hydrophilic particulate not bound to the fibres, but consisting of a similar material. The deposition of such kind of diaphragms is carried out by adjusting the suspension flow-rate across the cathode body and having the degree of vacuum as an independent variable. The amount of drawn suspension directly corresponds to the amount of deposited material, so that the flow-rate control allows following in a simple fashion the progressive accumulation of material and consequently the weight of the diaphragm, which together with the nature of the porosity is one of the most important parameters characterising its functioning in the cell. The nature of dependent variable of the degree of vacuum is nevertheless associated with the main inconvenience of this procedure. The dependency of the degree of vacuum on the amount of deposited material is reproducible between the different depositions only provided the composition of the suspension remains constant. The latter, however, tends to change in a scarcely predictable way due to a combination of phenomena including fibre sedimentation, fragmentation thereof, release of hydrophilic particles out of coated fibres, variation of viscosity under the action of micro-organism colonies. The consequence of these phenomena is the unpredictable trend of the degree of vacuum, which tends to increase more steeply with suspensions stored under stirring for prolonged times. The degree of vacuum is progressively self-reinforced under the effect of the compression of deposited materials and can lead to the formation of such compact layers that the flow of suspension is suppressed. As a first consequence of the premature blocking of the suspension flow, the obtained deposits may present weights largely lower than the programmed values and highly scattered, beside a compactness not always compatible with the operative conditions of industrial plants. In particular, plants carrying out the electrolysis of brines particularly rich in precipitatable impurities tend to be clogged to an uncontrollable extent with exceedingly compact diaphragms. On the other hand, an insufficient degree of compactness can nullify the separating action of the diaphragm completely.

It would, therefore, be desirable to have porous separators available with a controllable and reproducible porosity profile and a degree of compactness always adequate to the operating conditions of the electrolysis process. It would also be desirable that such porosity profile could be predetermined, for example based on process electrolyte features.

SUMMARY OF THE INVENTION

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter. As provided herein, the invention comprises, under one aspect a porous separator deposited on a cathode body of a diaphragm electrolytic cell, the porous separator formed by the superposition of a multiplicity of polymer fibre planes comprising primary pores generated by the interconnection of a multiplicity of primary interstices between the fibres, the size of the primary pores having an average value of about 2 to 10 μm, with a standard deviation not higher than 50% of the average value.

In another aspect, the invention comprises a method of deposition of a porous separator on a cathode body of a diaphragm electrolytic cell, comprising the vacuum sucking of a suspension containing polymer fibres and an optional particulate material through the cathode body while carrying out a continuous regulation of the degree of vacuum applied as a function of the fraction of deposited fibre in accordance with a predetermined profile until the end of the deposition.

In a further aspect, the invention comprises an apparatus for the deposition of a porous separator on a cathode body of a diaphragm electrolytic cell, comprising a vessel containing a suspension containing polymer fibres and an optional particulate material, equipped with a level sensor; means for applying a vacuum to a cathode body of a diaphragm electrolytic cell, equipped with a pressure sensor and an adjustment valve; means for handling said cathode body; and a central processing unit connected to the level sensor and the pressure sensor suitable for driving the handling means and the adjustment valve by executing a set of instructions contained in a program.

To the accomplishment of the foregoing and related ends, the following description sets forth certain illustrative aspects and implementations. These are indicative of but a few of the various ways in which one or more aspects may be employed. Other aspects, advantages, and novel features of the disclosure will become apparent from the following detailed description.

DESCRIPTION

Figure 1:
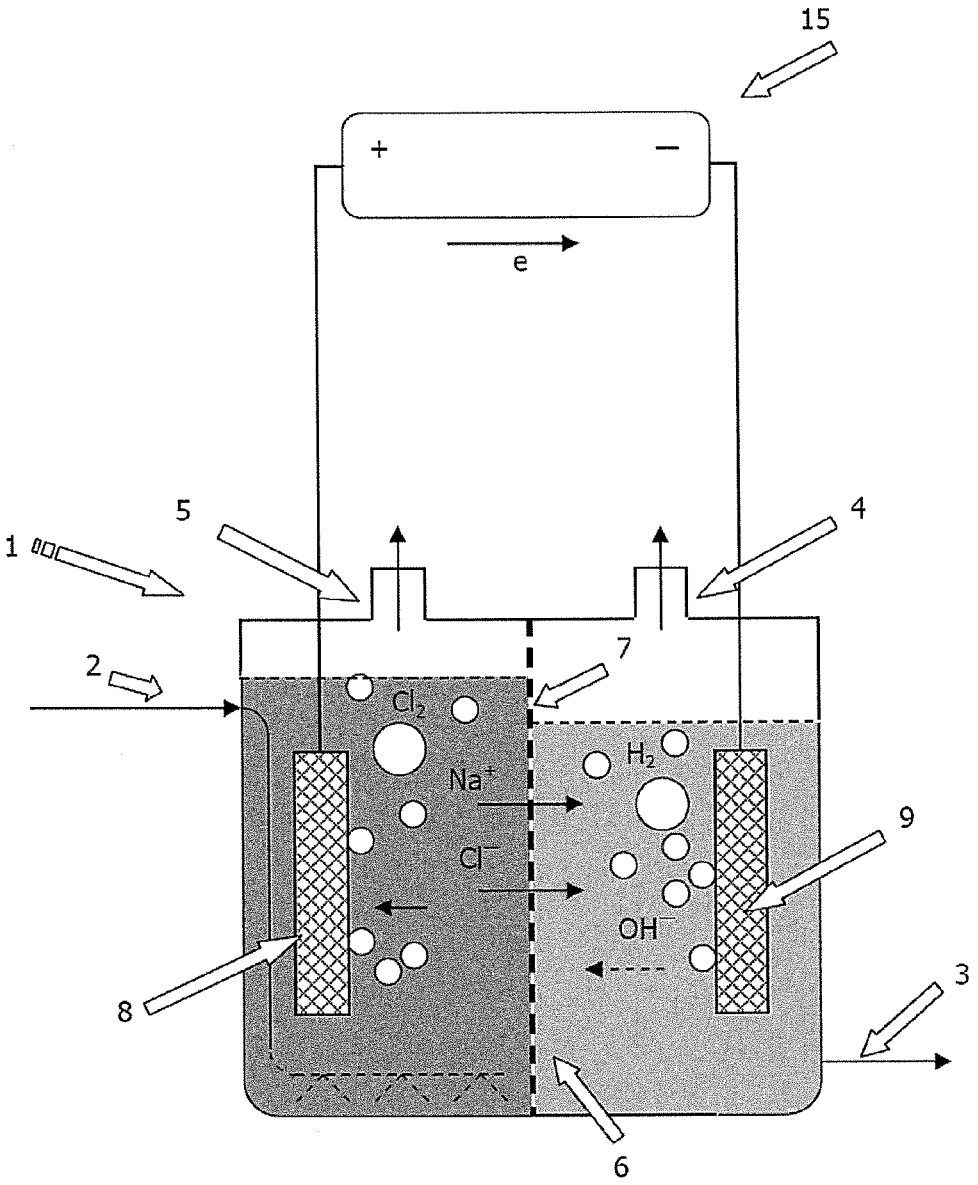
FIG. 1 illustrates a side-view of a diaphragm chlor-alkali cell according to an embodiment of the invention.

Various aspects of the invention are set out in the accompanying claims.

In one embodiment, the invention comprises a porous separator deposited on the cathode body of a diaphragm electrolytic cell formed by the superposition of a multiplicity of planes of polymer fibres, comprising primary pores generated from the interconnection of primary interstices between fibres having an average size of 2 to 10 μm with a standard deviation not higher than 50% of the average size.

In one embodiment, the polymer fibres are mechanically bound to ceramic oxide particles, for instance zirconium hydroxide in hydrated form impacted or embedded in the fibres. Polymer fibres can be reticulated, for instance by means of a sintering process and subsequent optional rehydration of oxide particles bound thereto. By oxide in hydrated form, it is hereby intended to mean an oxide comprising atoms of a metal, for instance zirconium, chemically bound to at least one hydroxyl group. This can have the advantage of imparting a sufficient degree of hydrophilicity to the separator.

In one embodiment, the porous separator further comprises secondary pores generated by interconnection of secondary interstices formed by the particles of a particulate material sequestered in the interior of the primary interstices. The particulate material and the secondary pores have an average size of about 0.5 to about 5 μm (micrometers) with a standard deviation not higher than 50% of the average size.

The availability of a porosity degree controlled to such an extent can have the advantage of providing a separator with very reproducible characteristics of permeability, which can be coupled to a suitable process electrolyte. In particular, separators obtained without particulate material turn out to be suitable for operation in plants supplied with brine of poor quality in terms of impurities liable to precipitate, for instance 0.3-2 ppm of calcium and/or magnesium. Conversely, separators obtained with particulate material sequestered inside the primary pores tend to be more suitable for operation with higher quality brines, for instance with concentrations of impurities liable to precipitate lower than 0.3 ppm.

In one embodiment, the particulate material sequestered inside the primary interstices comprises particles of hydrated ceramic oxides, for instance zirconium oxide characterised by the presence of permanent Zr—OH chemical bonds.

In one embodiment, a method for depositing a porous diaphragm with a controlled and predetermined porosity profile on the cathode body of a diaphragm electrolytic cell comprises the vacuum sucking of a suspension containing polymer fibres and optionally particulate material across the cathode body while carrying out a continuous regulation of the degree of vacuum applied as a function of the fraction of deposited fibre in accordance with a predetermined profile until the end of the deposition. The inventors have surprisingly found that depositing the diaphragm while controlling the degree of vacuum, rather than the flow-rate across the cathode body, as a function of the fraction of deposited fibre, allows obtaining separators having a porosity much more predictable in terms of average size and more strictly controlled in terms of standard deviation of the pore dimensions. The control of the degree of vacuum can be set up according to different profiles depending on the porosity and compactness that one wishes to obtain.

In one embodiment, the degree of vacuum applied during the deposition increases progressively according to a certain slope as a function of time, until reaching a maximum value of about 300 mm (millimetres) to about 650 $mm_{Hg}$. Final values of 300-350 $mm_{Hg}$ are typical of the more open diaphragms, whose use is advisable with process electrolytes particularly rich in impurities liable to precipitate, while final values of 600-650 $mm_{Hg}$ correspond to very closed diaphragms, useful with hyper-pure brines.

In one embodiment, at the end of the deposition cycle, the cathode body with the applied diaphragm is extracted from the fibre suspension and maintained at the final degree of vacuum for an additional period of about 30 minutes to about 3 hours. This has the advantage of further refining the diaphragm compactness control, since more compact diaphragms for a given pore distribution correspond to lengthier vacuum treatments outside the deposition bath. In one embodiment, the deposition and subsequent maintenance of the degree of vacuum are protracted until obtaining diaphragms having a controlled porosity as mentioned and an equally controlled thickness, for instance in the range of from about 3 mm to about 10 mm.

In one embodiment, an apparatus for carrying out the deposition of a diaphragm with control and regulation of the degree of vacuum as a function of the fraction of deposited fibre comprises a vessel suitable for containing the suspension of polymer fibres and optional particulate material, equipped with a level sensor; a vacuum pump or equivalent means for depressurising the cathode body of a diaphragm electrolysis cell, inclusive of a pressure sensor and an adjustment valve; handling means to plunge the cathode body whereon the diaphragm must be deposited into the vessel and for extracting the same therefrom; and a central processing unit (CPU) connected to the level and pressure sensors and suitable for actuating the handling means and adjustment valve by executing the instructions contained in a software programme. The level sensor has the purpose of indirectly calculating the amount of suspended material deposited onto the cathode body acting as a filter, but a person of skill in the art will be capable of providing analogous equipment to control the amount of deposited material. In another embodiment, the software program commanding the central processing unit can be selected each time from a predisposed library of programs, in order to produce diaphragms with a different porosity profile and a different degree of compactness as a function of the conditions of process electrolyte to be employed or of the available type of suspension or other operative parameters.

With reference to the drawing figures, FIG. 1 illustrates a cell 1 comprising a vessel subdivided by porous diaphragm 6 into two compartments, each containing an electrode connected to an external rectifier 15, respectively to the positive pole (anode 8, anodic compartment) and to the negative pole (cathode 9, cathodic compartment). The anodic compartment is fed with brine 2 (anolyte, aqueous solution containing about 300 g/l (grams/liter) of alkali chloride, for example NaCl) flowing across the diaphragm porosity and filling the cathodic compartment. Since the brine flow-rate is usually kept constant, in steady-state conditions a hydraulic head 7 is established between the two compartments, consisting of a brine column taller than the level in the anodic compartment. When rectifier 15 is switched on, an electrical current flows across the cell starting the electrochemical process which, in the case of sodium chloride electrolysis, consists of the following reactions taking place on the two electrodes:

$$(+)2NaCl \rightarrow Cl_2+2Na^++2e$$

$$(-)2H_2O+2e \rightarrow H_2+2OH^-$$

The overall reaction is as follows:

$$2NaCl+2H_2O \rightarrow Cl_2+H_2+2NaOH$$

Hence, the electrolysis process consumes sodium chloride and produces chlorine and caustic soda, which are the main products, besides hydrogen which is usually considered a by-product. Since brine is fed in excess with respect to the amount required for chlorine production, part of it flows across the diaphragm, penetrating the cathodic compartment and exiting therefrom mixed with caustic soda (catholyte, 3) whose concentration generally falls in the range of 110-130 g/l.

Figure 2A:
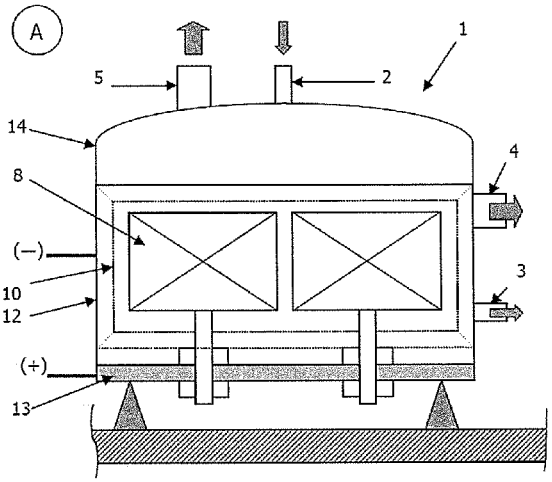
FIG. 2A illustrates a front view of internal details of a diaphragm chlor-alkali cell according to an embodiment of the invention.
Figure 2B:
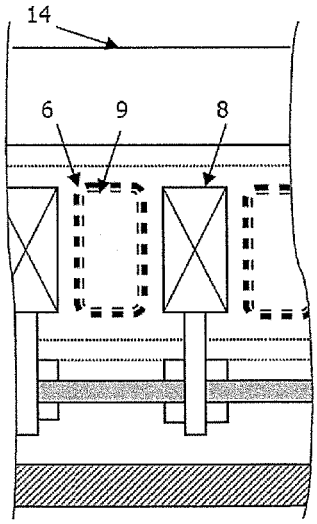
FIG. 2B is a side view of internal details of a diaphragm chlor-alkali cell according to an embodiment of the invention.
Figure 2C:
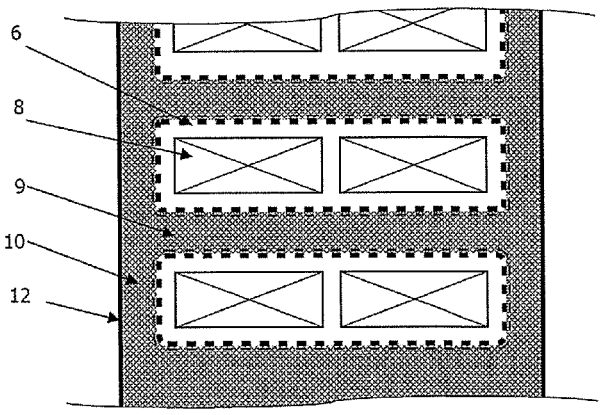
FIG. 2C is a top view of internal details of a diaphragm chlor-alkali cell according to an embodiment of the invention.

A monopolar-type real cell is illustrated in FIG. 2, wherein the details of FIG. 1 are indicated with the same reference numbers (A: front-view, B: side-view, C: top-view). In particular, the cell comprises a cathode body 12 comprising a rectangular prism delimited only by carbon steel sidewalls. The cathode body contains in its interior the cathode comprising a carbon steel structure comprised of a peripheral wall 10 and of cathode fingers 9, secured to the two opposed longitudinal surfaces of the peripheral wall. The peripheral wall and the fingers are made of wire mesh or punched sheet. On the structure, whose internal volume constitutes the cathodic compartment (or cathodic chamber), the porous diaphragm 6 is deposited. Chlorine and hydrogen are respectively discharged from nozzle 5 and nozzle 4.

Figure 3:
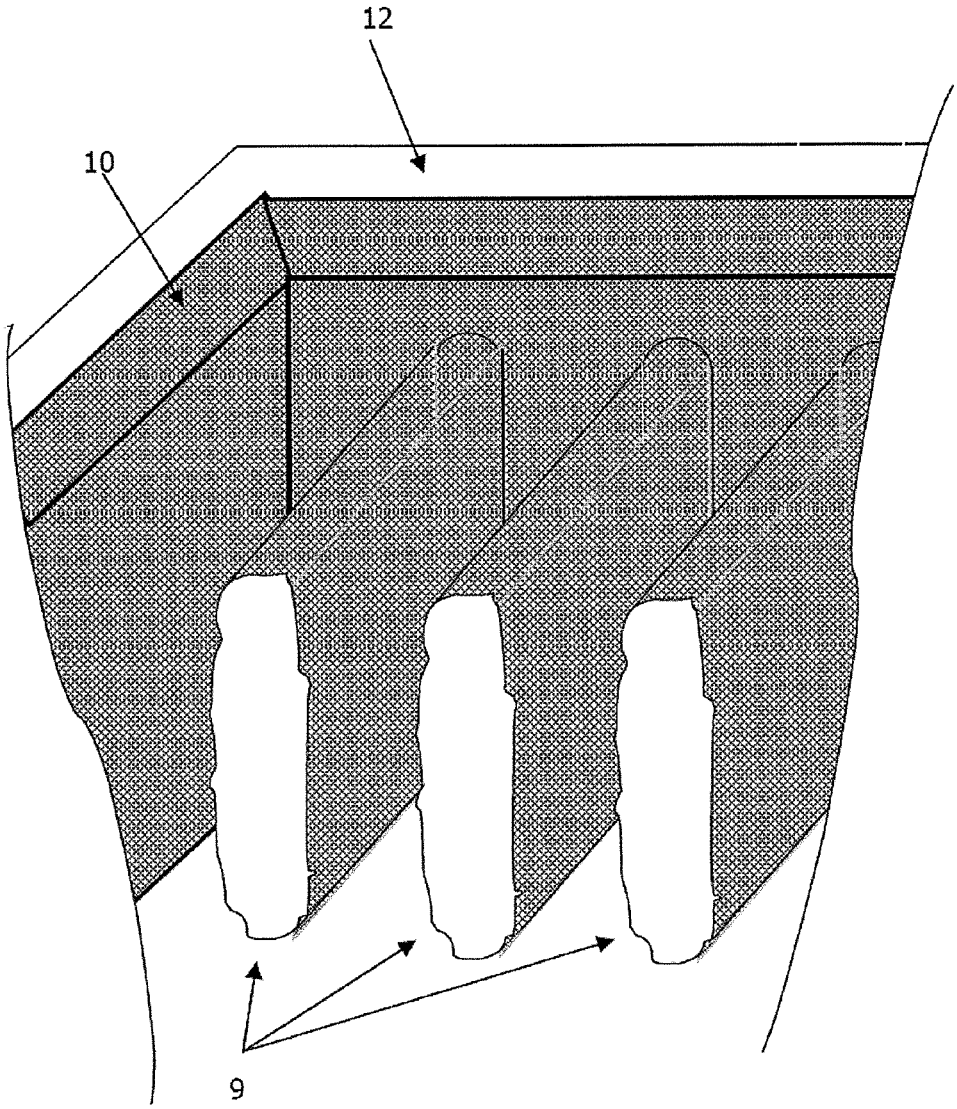
FIG. 3 illustrates a partial three-dimensional view of a cathode body of a diaphragm chlor-alkali cell according to an embodiment of the invention.

FIG. 3 shows a partial three-dimensional view of the cathode body. Cell 1 is assembled by securing the top part of cathode body 12 to cover 14 and the bottom part to anodic base 13 consisting of a copper sheet lined with a layer of chemically resistant rubber or with a thin layer of titanium.

In case the porosity and thickness of diaphragm 6 are not suited to the specific functioning conditions of plants, part of the caustic soda is liable to back-diffuse and enter the anodic compartment, notwithstanding the opposite direction of the brine flow. Such fraction of caustic soda represents a loss of productive efficiency, thus entailing a higher specific energy consumption (kWh/ton). Moreover, caustic soda penetrating the anodic compartment forms oxygen at the anode and reacts with chlorine, thereby generating sodium hypochlorite and chlorate in the anolyte bulk:

$$4NaOH \rightarrow O_2+2H_2O+4Na^++4e$$

$$2NaOH+Cl_2 \leftrightarrow NaClO+NaCl+H_2O$$

$$3NaClO \rightarrow NaClO_3+2NaCl$$

The presence of oxygen in product chlorine lessens its quality and may preclude its use in some production processes of plants downstream the electrolysis. Hypochlorites and chlorates are dragged by the brine flow to the cathodic compartment where they eventually contaminate the product caustic, decreasing its commercial value.

During the start-up phase, the brine level must be at least sufficient to cover fingers 9 completely, in order to prevent hydrogen present in the cathodic chamber from diffusing into the anodic compartment from forming an explosive mixture with chlorine.

During functioning, the precipitation of certain impurities contained in the brine clogs the diaphragm more or less quickly, determining a progressive increase in the level of the anodic compartment, whose maximum limit is associated with the height of cover 14. Once reached the maximum allowable limit for the level, shutting down the cells is mandatory to apply cleaning procedures aimed at restoring the original situation. To avoid affecting the overall economics of plants, it is important that these shut-downs are distanced in time inasmuch as possible, for instance occurring after no less than 3-6 months of uninterrupted operation.

Figure 4:
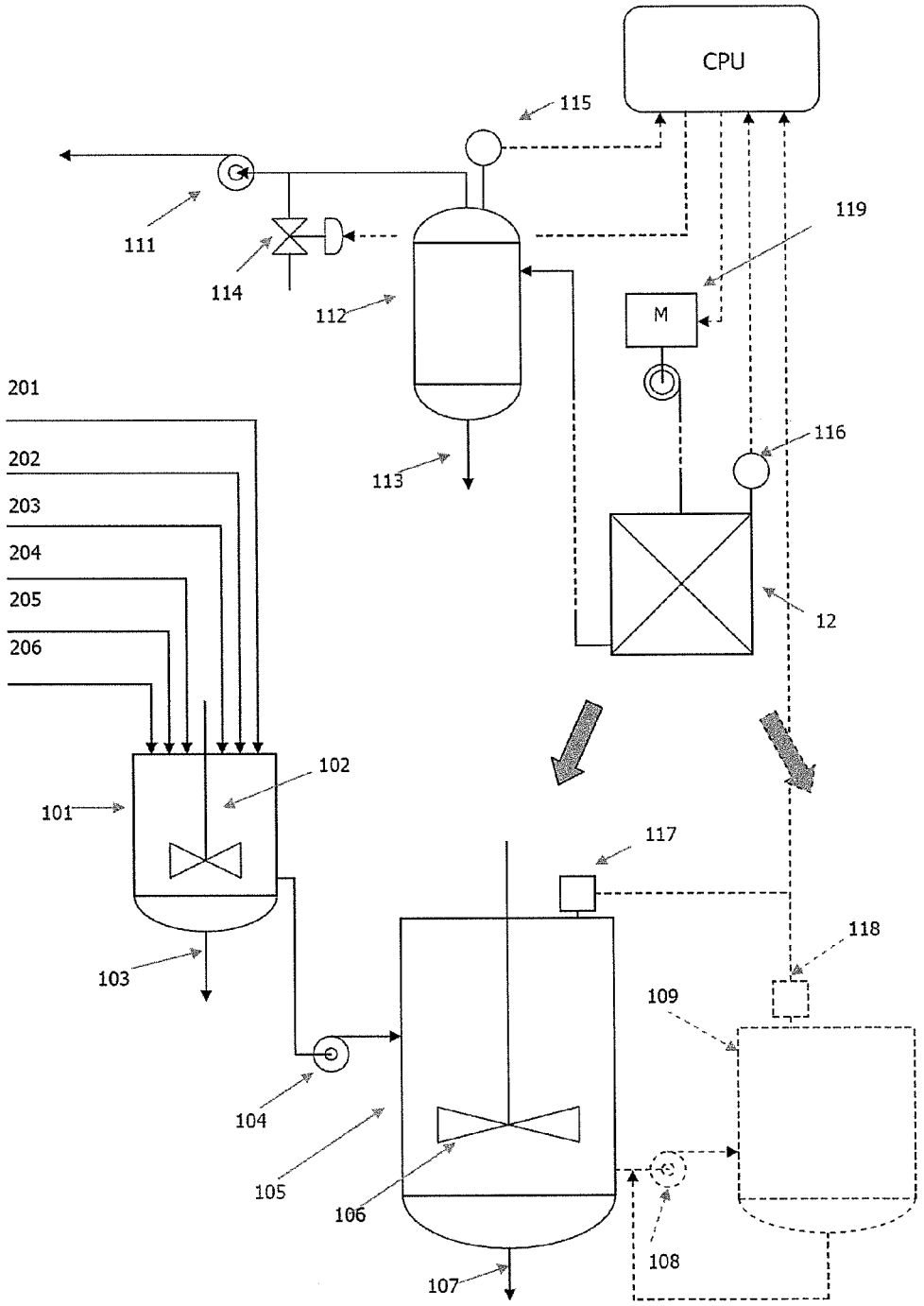
FIG. 4 is the operative scheme of an apparatus for controlled diaphragm deposition according to an embodiment of the invention.

The procedure according to the invention provides manufacturing diaphragms by controlling the degree of vacuum as a function of the percentage of deposited material rather than acting on the flow-rate of the suspension. To ensure the best correspondence between effective and projected diaphragm deposition, such deposition can be carried out by means of an apparatus equipped with a central processing unit (CPU) which elaborates information transmitted by sensors applied to the equipment based on a suitable software program, activating the control of the degree of vacuum as a function of the percentage of deposited material, and replicating a preset profile selected on the basis of information loaded by operators. A suitable plant is illustrated in its main components in FIG. 4, wherein 101 indicates the reactor for the preparation of the suspension, 102 the relevant stirrer, 103 the non-suspendable residue outlet, 104 the pump for transferring the suspension contained in the reactor, 105 the storage vessel for the suspension, 106 the extractable stirrer in case the deposition is carried out in the same storage vessel, 107 the non-suspendable product outlet, 108 the pump for transferring the suspension from the storage vessel to the deposition vessel 109, useful in case the deposition is not directly carried out in the storage vessel, 12 the cathode body enclosing the internal structure of mesh or punched sheet whereon the diaphragm must be applied, 111 the vacuum pump used during the deposition, 112 the intermediate vessel, 113 the filtrate outlet, 114 the arrangement of valves used for adjusting the degree of vacuum to be applied to the cathode body, 115 and 116 the vacuum degree detectors respectively in the intermediate vessel and in the cathode body, 117 and 118 the suspension level detectors in the storage vessel and in the optional deposition vessel, 119 the handling system of the cathode body, 201, 202, 203, 204, 205 and 206 respectively the feeds of antifoam, biocide, particulate material, fibre, thickener and water to reactor 101.

Figure 5:
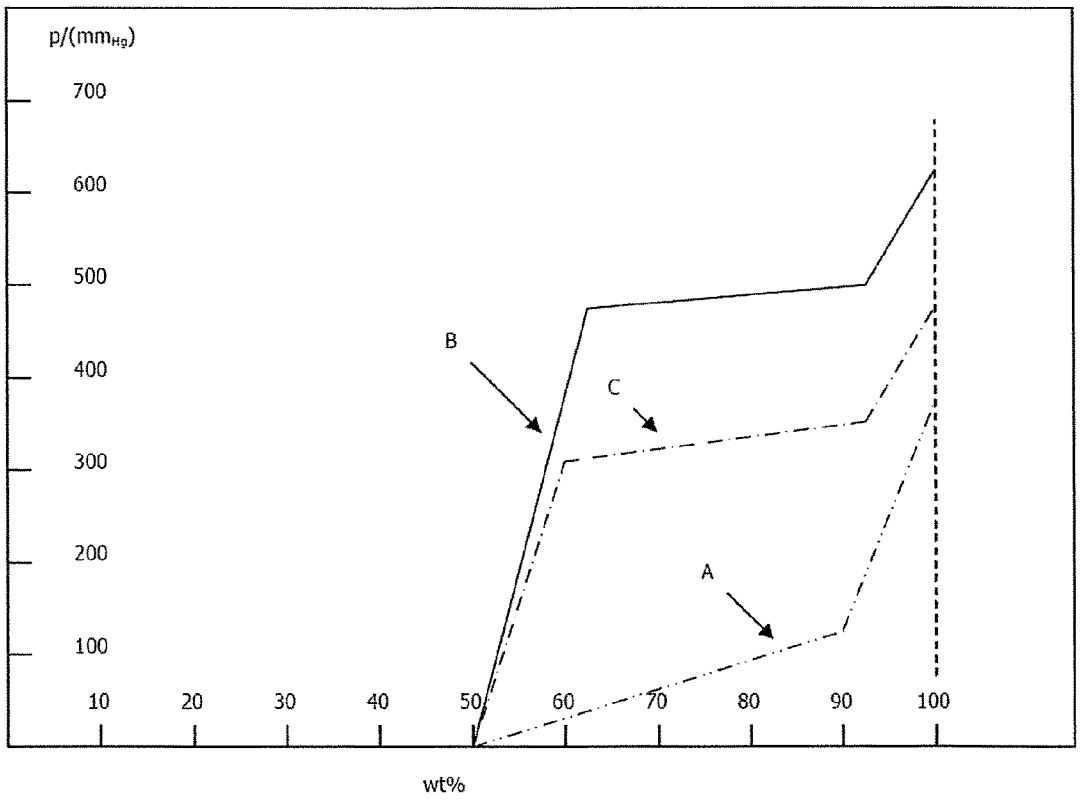
FIG. 5 is a diaphragm reporting the ratio of applied degree of vacuum to fraction of deposited material for three diaphragms with different porosity profile.

Inventors have preliminarily studied the behaviour of various types of diaphragms in laboratory tests followed by assessments on industrial plants and have identified certain optimal features of diaphragms, such as thickness and size distribution of pore diameters, for a satisfactory functioning (minimum acceptable safety levels, prolonged operation times before reaching maximum allowable levels, concentration of product caustic between 110 and 150 g/l) in a number of operative conditions that virtually cover the entirety of existing industrial plants (in terms of electrical current density, brine flow-rate, concentration of precipitatable impurities either contained in brine permanently or periodically present, due for instance to malfunctioning or non-standard operative procedures). Deposition procedures were then defined for the types of diaphragms selected as optimal during the first research phase, characterised by the degree of vacuum applied to the cathode body (p/mm$_{Hg}$, in ordinate) as a function of the percentage of deposited material with respect to the predetermined total amount (wt %, in abscissa). FIG. 5 shows three typical situations. The percentage of deposition starts from an indicative value of 50% representing the amount of material spontaneously deposited at the time of dipping the cathode body. Curves corresponding to the three procedures, indicated as A, B and C, are independent of the time required for the deposition and the flow-rate of suspension, the latter being dependent variables recorded for the mere purpose of allowing a subsequent analysis, useful to implement possible modifications.

In particular, curve A refers to the deposition of a diaphragm characterised by high porosity and therefore suitable for operation in plants supplied with poor quality brines, containing high concentrations of precipitatable impurities, for instance 1-1.5 ppm of magnesium which is known to be one of the most active agents in determining diaphragm clogging with the associated anodic level increase. It was observed that the structure of diaphragms deposited under moderate vacuum, typically 100-300 mm$_{Hg}$, practically for the whole duration of the deposition, is comprised of pores formed by the interconnection of primary interstices generated by the progressive accumulation of a multiplicity of plans of fibres, typically having length and diameter of respectively 1 to 10 mm and 10 to 100 μm. The particulate optionally contained in the suspension is substantially dragged into the filtrate liquid. The fraction that gets trapped inside the primary interstices is uniformly distributed in the deposit thickness (the ratio of fibre to particulate material being higher in the deposit than in the suspension) when its size distribution falls approximately in the range of 0.5 to 2 μm. For this reason, suspensions used in this case are free of particulate or alternatively contain only small quantities thereof (high values of fibre/particulate weight ratio). Since the particulate does not get blocked, the primary interstices and consequently the pores they generate must be characterised by a diameter distribution centered around typical values of 2-10 μm. To these values correspond high volumes capable of incorporating high amounts of precipitates during operation in the cell, thereby ensuring prolonged functioning times. Inventors also noticed that satisfying production yields (low caustic back-diffusion to the anodic compartment, lower oxygen content in chlorine, lower hypochlorite and chlorate concentration in the catholyte) are obtained when pore diameters present a standard deviation within 50% of the average value. Such kind of porosity might lead to low brine starting levels, non compatible with operational safety It is nevertheless possible to obviate this inconvenience by acting on the total amount of deposition until getting a sufficient thickness, typically 3 to 10 mm. Such provision brings about a further advantage, since a higher thickness makes pore distribution to be less dispersed around the average value. During the final part of the deposition the vacuum is rapidly increased while the cathode, upon completion of diaphragm formation, is extracted from the suspension and maintained in air, in order to allow the withdrawal of part of the suspension trapped in the pores before proceeding with drying and sintering. It was found that a final vacuum not lower than that employed during the deposition is required to prevent the diaphragm from slipping from the cathode body under the effect of its own weight. However, it was also found that the vacuum must not exceed certain values to avoid an excessive compactness of the diaphragm caused by the mechanical collapse of the structure in which a volume of vacuum is created by virtue of the withdrawal of part of the suspension trapped inside the pores.

The production of this type of diaphragm is carried out by dipping the cathode body 12 in the vessel containing the suspension (105 or 109) and waiting for the filling of the cathode chamber to be completed during a predetermined period of time. After this waiting time, vacuum is applied. Vacuum pump 111 is kept functioning at full regime and the degree of vacuum is adjusted by acting on valve 114. Initially, the valve is completely open and, if it is suitably dimensioned, the air flow-rate to the pump is such that the vacuum detected in the cathode body by a pressure sensor 116 is practically nil. The valve is progressively closed, decreasing the air flow-rate to the pump and adjusting the degree of vacuum as a function of the amount of material being deposited, obtained by elaborating the level variation detected by suspension level sensors (117 or 118). In the final step of extraction of the cathode body, the opening of the adjustment valve is further reduced with increase of the vacuum up to the prescribed value for maintenance in air.

The deposition procedure can be carried out manually, requiring however a team of qualified operators, one of which assigned to handling the cathode body, one to operating the vacuum adjustment valve and one to detecting the suspension level and converting it to weight of deposited material. Such a procedure entails possible inaccuracies in the execution, which can be completely overcome by binding the whole deposition plant to a CPU. The CPU receives the necessary information from vacuum (115, 116) and level (117, 118) sensors, elaborating the same and sending the commands to motorised adjustment valve 114 and to handling system 119 of cathode body 12. In order to function correctly, the CPU is equipped with a software program comprising a set of deposition profiles suitable for producing diaphragms with the desired features. The selection of optimum profile and of quantity to be deposited is carried out by the CPU based on the data input from operators (suspension characteristics such as viscosity, concentration of total suspended solids, fibre to particulate ratio, date of preparation, operative characteristics of the specific electrolysis plant such as size of the cathode body whereon the diaphragm must be deposited, brine quality, current density, concentration of caustic soda to be produced, minimum allowable level difference). The program further contains instructions required to start-up the deposition comprising dipping of the cathode body 12 in the suspension with the relevant initial waiting times, start-up of vacuum pump 111, elaboration of level variation data to be converted to percentage of deposited material, commands to adjustment valve 114 and handling system 119 of cathode body 12 and finally maintenance of cathode body 12 under vacuum in air for predetermined times after extraction from the suspension. The CPU can also carry out auxiliary operations which may for instance lead to decide to vary the vacuum profile after a predetermined time since the moment the signal difference sent by the two vacuum sensors installed on the storage or deposition vessel (105, 109) and on the intermediate vessel 112 becomes nil.

Curve B relates to the production of a diaphragm characterised by a substantially more compact structure than that typical of the diaphragm of procedure A since practically all of the residual 50% is deposited under high vacuum, typically 300-600 $mm_{Hg}$.

The compacting of the deposited material leads to a sensible decrease in the size of porous interstices formed by the fibres. If the suspension is added with a suitable amount of particulate, the decrease in size of primary interstices favours the entrapment of particles giving rise to secondary interstices between each other. Inventors have found out that the interconnection of secondary interstices generates a new population of pores characterised not only by small diameters but also by a narrow size distribution typically represented by a standard variation of about 50% the average value. Such distribution characterises also the secondary interstices and hence the pores. This situation is obtained by using CC01 type zirconium oxide, currently commercialised by St. Gobain/France, as particulate. This product contains at least 80% by weight of particles comprised between 0.5 and 1.5 μm with an average value of 1 μm. Diaphragms prepared making use of this type of particulate are therefore characterised by a pore population with a diameter size distribution centred around 1 μm with a standard deviation within 50% of such value. It was found that this kind of diaphragm has the advantage of presenting both an initial brine level high enough to guarantee the functioning safety conditions and a high yield of production.

The two advantages of safety level and high yield of production are nevertheless counterbalanced by the tendency of pores to be rapidly clogged by precipitates as a consequence of their small volume. These diaphragms can, therefore, be used only in plants supplied with high quality brine containing small amounts of precipitatable impurities, such as 0.1 ppm max of magnesium.

This inconvenience can be overcome if the particulate contained in the suspension has a size distribution that, although narrow, is centred around values higher than those of 0.5-1 μm seen in the case of CC01 zirconium oxide, such as occurs with types CC05 and CC10 also commercialised by St. Gobain. Since the size distribution of secondary interstices, thus of pores generated by their interconnection, depends on size distribution of particulate trapped inside primary interstices, the pores of such diaphragms have bigger diameters resulting therefore more resistant to clogging by precipitates, although presenting a still acceptable initial brine level.

The vacuum is further increased in the final step of extraction of the cathode body from the suspension not primarily to prevent the deposit from slipping (the vacuum is in fact already at suitable levels) but rather to increase the compactness by virtue of the higher amount of suspension withdrawn from the diaphragm (formation of a higher volume of vacuum with consequent greater mechanical collapse).

Manual activities, or preferably the functioning of the whole deposition system under CPU control, are totally analogous to what seen in the case of A-type diaphragms.

Curve C in FIG. 5 relates to the production of diaphragms with intermediate porosity and thickness features suitable for functioning in plants fed with medium quality brines wherein precipitatable impurities have relatively small concentration, in the range of 0.1 to 0.3 ppm, but presenting small peaks from time to time up to 1-2 ppm. The structure is obtainable by means of a vacuum profile maintained at intermediate levels with respect to those used for the deposition of highly porous (curve A) and of compact (curve B) diaphragms.

Some of the most significant results obtained by the inventors are presented in the following examples, which are not intended as a limitation of the extent of the invention.

EXAMPLE 1

A lab cell consisting of a cathode body and an anode body, each made of a pan equipped with a peripheral frame respectively of carbon steel and titanium, was used. The pan of the cathode body was provided with a mesh, spot-welded to the frame and co-planar thereto, consisting of carbon steel wire and characterised by a square mesh of 2 mm×2 mm internal size, equivalent to the mesh type used in the construction of industrial cathode bodies. The anodic pan was equipped in its turn with a titanium expanded sheet provided with a catalytic coating for chlorine evolution, comprising oxides of ruthenium and titanium. The expanded mesh was secured to the pan wall by means of elastic supports. The two pans were equipped with the necessary nozzles for feeding the brine and for discharging hydrogen gas, chlorine gas and catholyte, the latter consisting of a mixture of sodium chloride and caustic soda. The cathode body was further provided with a diaphragm obtained by deposition from a suitable suspension. The cell was assembled by mutually tightening the two pans with suitable gaskets as required to ensure the sealing from the environment, with PTFE rods of 1.5 mm of diameter inserted between diaphragm and anode mesh in order to establish a reproducible diaphragm to anode mesh gap.

The deposition procedure employed for the diaphragm was the following:

- suspension comprising 80 g/l of PTFE fibre (3-9 mm length, 20-80 μm diameter) coated with zirconium oxide particles; 20 g/l of zirconium oxide with 80% of the particles in the range of 0.5 to 1.5 μm; thickener in an amount such as to impart a viscosity of 1650 cP as measured with a Brookfield N.1 viscometer at 1 rpm.
- immersion of the cathode body into the deposition vessel containing the suspension kept at 25° C. under slight depression so as to complete the internal volume filling within 10 minutes, the vessel being provided with a suspension level detector Start-up of the vacuum pump with complete opening of an adjustment valve of suitable section connected to the atmosphere, in order to establish a max degree of vacuum of 10 $mm_{Hg}$, with subsequent connection to the cathode body decrease of the adjustment valve opening so as to establish a progressively increasing degree of vacuum inside the cathode body, up to a value of 200 $mm_{Hg}$ in correspondence of the deposition of 97% of the predetermined amount for obtaining a 5 mm thick diaphragm, quick increase of the degree of vacuum to 300 $mm_{Hg}$ with simultaneous extraction of the cathode body from the suspension maintenance in air under a vacuum of 300 $mm_{Hg}$ for 2 hours, subsequent drying at 100° C. for 3 hours and at 120° C. for 2 more hours, final sintering in oven at 350° C. for 2 hours.

Porosity features were checked, detecting a diameter size distribution with 80% of diameters falling in the range of 1.8 to 3 μm.

The cell assembled with the sintered cathode body was operated at the following conditions:

inlet brine: 300 g/l of sodium chloride, pH 2, calcium and magnesium respectively 1.5 and 1 mg/l current density 2.5 $kA/m^2$ temperature: 90° C.

caustic soda concentration: 130 g/l

After 30 hours of functioning, necessary to reach steady-state conditions, brine level, caustic soda production yield and chlorate concentration in product caustic soda were recorded as the most significant operative parameters.

The level turned out to be 10 cm higher than the diaphragm upper edge, with a yield of 92% and a chlorate concentration of 0.3 g/l. The brine was then added with magnesium chloride for 3 hours in order to produce a further level increase to 24 cm. These data remained practically unvaried during the following 4 weeks, showing only marginal oscillations.

EXAMPLE 2

A cell as the one described in Example 1 but equipped with a second type of diaphragm was operated in the same experimental conditions.

The suspension used for the deposition of the diaphragm was analogous to the one of Example 1 except for the different concentrations of fibre and of zirconium oxide, brought respectively to 60 and 30 g/l. Zirconium oxide was again of the type characterised by 80% of the particles in the range of 0.5 to 1.5 μm. The deposition was carried out by adjusting the degree of vacuum to 450 $mm_{Hg}$ since the beginning, progressively increasing it to 550 $mm_{Hg}$ until depositing 95% of the predetermined amount for obtaining a 3 mm thick diaphragm, then quickly increasing it to 650 $mm_{Hg}$ with simultaneous extraction of the cathode body from the suspension.

The remaining steps of air maintenance under final vacuum conditions, drying and sintering were carried out as in Example 1. Also in this case, the diaphragm porosity was characterised observing a size distribution of 0.4 to 1.4 μm for 80% of the particles, hence equivalent to that of zirconium oxide particles.

After 25 hours of functioning, necessary to reach steady-state conditions, the level turned out to be 32 cm higher than the diaphragm upper edge, with a yield of 95% and a chlorate concentration of 0.15 g/l. In the following week of operation a time-linear progressive level amount was observed, up to 49 cm: by extrapolating these data, it was determined that the brine level would have reached the maximum height of 1 metre within the following 3 weeks. The concentration of calcium and magnesium was then decreased to 1 and 0.1 mg/l respectively. For that moment on, the level was substantially stabilised, with a yield and chlorate concentration always centred around more than satisfying values.

EXAMPLE 3

A cell as described in Examples 1 and 2, but equipped with a third type of diaphragm, was operated in the same experimental conditions.

The suspension used for the deposition of the diaphragm was analogous to the one of Example 2, the only difference being the zirconium oxide type characterised by 80% of the particles in the range of 0.8 to 2.5 μm.

The deposition was carried out as in Example 2, same as the maintenance, drying and sintering steps.

The diaphragm porosity showed a size distribution of 0.7 to 2.2 μm for 80% of the particles, hence equivalent to that of zirconium oxide particles.

After 27 hours of functioning, necessary to reach steady-state conditions, the level turned out to be 27 cm higher than the diaphragm upper edge, with a yield of 96% and a chlorate concentration of 0.14 g/l. During the 4 following weeks, the level increased marginally up to 31 cm and for this reason the calcium and magnesium concentration could be kept unvaried at 1.5 and 1 mg/l respectively.

The previous description is not intended to limit the invention, which may be used according to different embodiments without departing from the scopes thereof, and whose extent is univocally defined by the appended claims.

Throughout the description and claims of the present application, the term "comprise" and variations thereof such as "comprising" and "comprises" are not intended to exclude the presence of other elements or additives.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

What we claim is:

1. Method of deposition of a porous separator on a cathode body of a diaphragm electrolytic cell, comprising:

immersing the cathode body into a deposition vessel containing a suspension comprising polymer fibers and an optional particulate material;

detecting a suspension level of the suspension in the deposition vessel using a level sensor;

detecting a vacuum level in the deposition vessel;

vacuum sucking the suspension containing polymer fibers and the optional particulate material through the cathode body by continuously adjusting the degree of vacuum applied as a function of the weight % of deposited fiber with respect to a predetermined total amount of deposited fiber wherein the weight % is calculated from a variation of the suspension level detected from the level sensor;

obtaining a predetermined porous separator profile on the cathode body at the end of the deposition, wherein the obtained porous separator comprises a superposition of a multiplicity of polymer fiber planes comprising primary pores generated by the interconnection of a multiplicity of primary interstices between the fibers, the primary pores having an average value of about 2 to 10 microns.

2. The method according to claim 1, wherein at the end of the deposition the method further comprises extracting the cathode body with the applied diaphragm and maintaining a degree of vacuum not lower than the degree of vacuum at the end of the deposition for a time of about 0.5 hours to about 3 hours.

3. The method according to claim 1, wherein the degree of vacuum applied during the deposition reaches a maximum value of about 300 mm to about 650 $mm_{Hg}$.

* * * * *